United States Patent [19]

Stoll et al.

[11] Patent Number: 4,866,954

[45] Date of Patent: Sep. 19, 1989

[54] FLAT KNITTING MACHINE

[75] Inventors: Heinz P. Stoll, Eningen; Thomas Stoll; Ernst Goller, both of Reutlingen, all of Fed. Rep. of Germany

[73] Assignee: H. Stoll GmbH & Co., Reutlingen, Fed. Rep. of Germany

[21] Appl. No.: 326,805

[22] Filed: Mar. 21, 1989

[30] Foreign Application Priority Data

Apr. 15, 1988 [DE] Fed. Rep. of Germany ..... 3812488

[51] Int. Cl.[4] ..... D04B 15/00

[52] U.S. Cl. ..... 66/115

[58] Field of Search ..... 66/115, 114, 64, 78, 66/62, 8

[56] References Cited

U.S. PATENT DOCUMENTS 4,610,150 9/1986 Hiromoto et al. ..... 66/115

*Primary Examiner*—Ronald Feldbaum

*Attorney, Agent, or Firm*—Larson and Taylor

[57] ABSTRACT

In a flat knitting machine, the segments (10.1,11.1), of any desired width, which make up the needle beds (10, 11), are designed to be used with needles of different gauges, i.e. are formed with a different needle separation, so that needles of different gauges are used in adjacent needle bed segments (10.1, 11.1). On a flat knitting machine comprising a carriage (14/15) which can be traversed across the needle beds (10, 11) and has several cam systems (14.1–14.4; 15.1–15.4), the individual cam systems can be allocated to needles of different gauges, while at least one of the several cam systems may differ from the others by a different form of loop-transfer control curve.

8 Claims, 1 Drawing Sheet

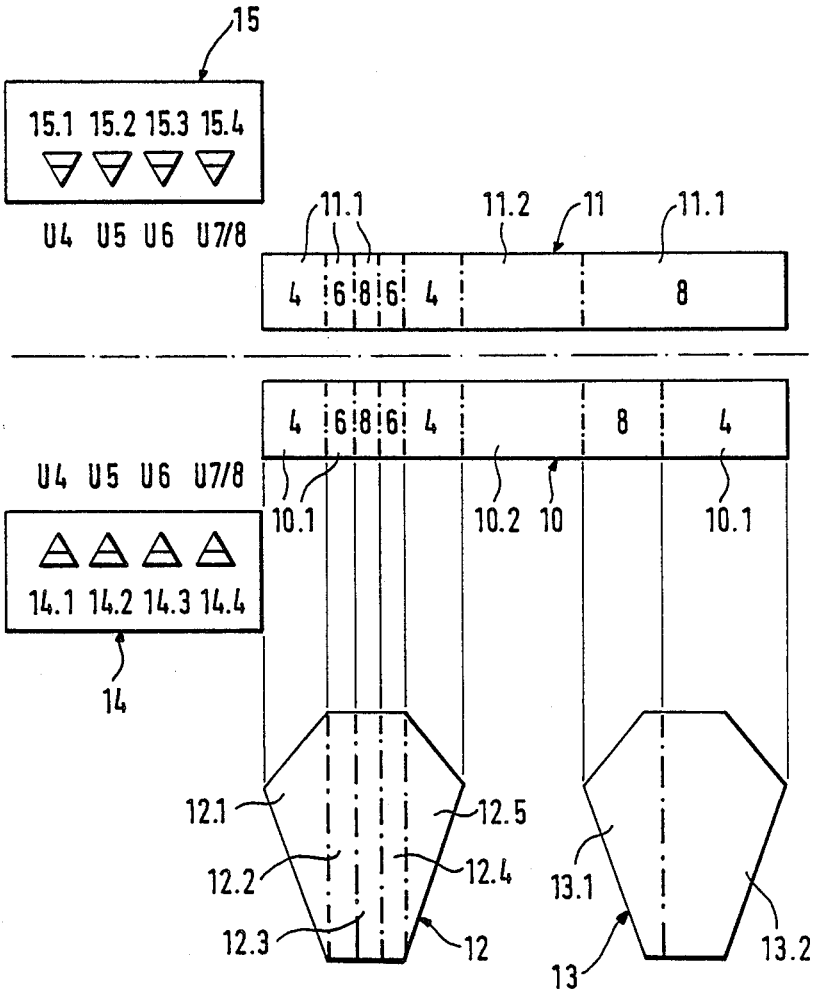
15
15.1 15.2 15.3 15.4
U4 U5 U6 U7/8
11.1
11.2
11
11.1
4 6 8 6 4 8
4 6 8 6 4 8 4
U4 U5 U6 U7/8
10.1
10.2
10
10.1
14.1 14.2 14.3 14.4
14
12.1
12.5
12.2
12.4
12.3
12
13.1
13
13.2

FLAT KNITTING MACHINE

BACKGROUND OF THE INVENTION

1. Field of the Invention

The invention relates to a flat knitting machine having a front and back needle bed, equipped with needles, with each of said needle beds being made up from single exchangeable segments.

2. Description of the Prior Art

It is already known or has been suggested to make up the needle beds of flat knitting machines from individual bars, of which two adjacent ones define the guiding channel, groove or trick for a needle. It is also known to join the individual bars into groups and align these bar groups as individual segments of a needle bed.

In principle, the idea is also known to arrange a needle bed in such a way that it is possible by means of a suitable arrangement of needles to knit thereon with two different stitch gauges (DE-GM 18 72 478). However, up till now this idea could only be realised to a limited extent or on older machine types having simple cam systems, and therefore it has not gained any practical significance until now.

BRIEF SUMMARY OF THE INVENTION

The invention is based on the subject of configuring a modern type flat knitting machine such that it can be used with needles of different gauges.

According to the invention, this object is achieved by means of a flat knitting machine of the above mentioned kind, on which the segments of the needle beds have a different needle separation, so that needles of different gauges can be used in adjacent needle bed segments.

In the case of the flat knitting machine according to the invention, the needles of different gauges can be arranged on the needle beds in any desired way, depending on whether several separate knitted articles are to be produced and on whether stitches of different gauges are to be arranged symmetrically or asymmetrically in these knitted articles. The exchangeable segments of the needle beds can be of different widths, which allows areas of various widths with stitches of different gauges to be knitted.

If the invention is to be utilised on modern type flat knitting machines having carriages with several cam systems, the individual cam systems can each be allocated to needles of different gauges, and the machines can be controlled in such a way that different cam systems can form the stitches in the different segments. For this purpose it is advantageous if at least one of the several cam systems differs from the others by a different form of loop-transfer control curve.

Tests have shown that a flat knitting machine according to the invention can be equipped with needles of virtually any customary gauges. It is advantageous if the carriage has one knitting and loop-transfer cam system for needles of the gauges 2–4, one for needles of the gauges 3–5, one for needles of the gauges 4–6 and one for needles of the gauges 7 and 8. In the case of flat knitting machines having an electronic control facility which is per se known and which allows a reversal of the carriage at any desired position of the needle beds made up from different segments, the use of different cam systems in different zones of a needle bed does not cause any problems. Even less difficult is the utilisation of the invention on knitting machines on which a separate drive is provided for each needle of each needle bed.

BRIEF DESCRIPTION OF THE DRAWINGS

The principle of the invention is explained below in more detail in an embodiment shown by way of example with reference to the accompanying schematic drawing of a twin-bed flat knitting machine having a carriage with four cam systems each.

DESCRIPTION OF THE PREFERRED EMBODIMENT

The schematic drawing shows the front needle bed 10 and the back needle bed 11 of a flat knitting machine, both beds being made up from individual segments 10.1 and 11.1 of differing lengths. The joints between the individual segments 10.1 and 11.1 of the needle beds 10 and 11 are indicated by emboldened dotted lines. All the needle bed segments 10.1 and 11.1 shown in the embodiment example, which are equipped with needles, are identified with numbers 4, 6 or 8 indicating the gauge of the respective needles. On the flat knitting machine, two separate knitted fashioned articles 12 and 13 are to be produced. For this reason, there are middle segments 10.2 and 11.2 present in the needle beds, which have no needles provided therein, because these areas are not intended to be used for knitting. One knitted article 12 is designed to have five areas of different stitch gauges being symmetrically distributed on the knitted article. The two outer segments 12.1 and 12.5 are knitted with needles of gauge 4, the adjacent areas 12.2 and 12.4 with needles of gauge 6, and the middle area 12.3 is knitted with needles of gauge 8. In the case of the other knitted article 13 two knitted areas of unequal dimension are provided asymmetrically arranged, of which the smaller knitted area 13.1 is intended to be knitted with needles of gauge 8 and the larger knitted area 13.2 with needles of gauge 4. In the areas of the needle beds 10 and 11 intended for the formation of the knitted article 12, equal needle bed segments 10.1 and 11.1 are made up in the front needle bed 10 and the back needle bed 11. In the knitted area for the knitted article 13, however, the needle beds 10 and 11 have different segments, viz. the front needle bed 10 has a segment for needles of gauge 4, whereas the back needle bed 11 has—as an example for variation possibilities - only a single segment with needles of gauge 8. It would also be possible to select a segment with needles of gauge 5 instead of a segment with needles of gauge 8. In this case a needle-by-needle racking of the needle bed would have to be carried out when loop-transferring the stitches, and, after transferring a loop to a needle, the racking would have to be reinitiated. In the case of the single needle drive mentioned above, however, the loop-transfer can be controlled without any problems.

The schematic drawing also shows the two carriage halves 14 and 15 for the front needle bed 10 or the back needle bed 11. Each carriage half is equipped with four cam systems 14.1, 14.2, 14.3, 14.4 and 15.1, 15.2, 15.3 and 15.4, each of which are combined knitting and loop-transfer cam systems identified by triangles. Each cam system is allocated to a different needle gauge, which is indicated by the reference numbers U4, U5, U6 and U7/8. This means that the cam systems 14.1 and 15.1 are intended to control the needles of gauge 4, the cam systems 14.2 and 15.2 to control the needles of gauge 5, the cam systems 14.3 and 15.3 to control the needles of gauge 6, and the cam systems 14.4 and 15.4 to control the needles of gauges 7 and 8.

Not illustrated on the drawings are an electronic control device and the drive unit for the carriage 14/15, which allow a reversal of the carriage at any desired position of the needle beds, including at each transition from one needle bed segment 10.1, 11.1 to the next, and a selection of the cam systems of the carriage halves 14, 15, which are used in the individual segments 10.1 and 11.1 of the two needle beds 10, 11.

We claim:

1. A flat knitting machine having a front needle bed, a back needle bed, said beds being equipped with needles, each said bed comprising a plurality of single exchangeable segments, wherein the segments have different needle separations so that needles of different gauges can be used in adjacent needle bed segments.

2. A knitting machine according to claim 1 and including a carriage having several cam systems, the carriage being traversable across the needle beds and having individual cam systems allocated to needles of different gauges.

3. A knitting machine according to claim 2 wherein at least one of the several cam systems differs from the others by a different form of loop-transfer control curve.

4. A knitting machine according to claim 2 wherein the carriage comprises respective knitting and loop-transfer cam systems for needles of gauges 2 to 4; 3 to 5; 4 to 6; and 7 and 8.

5. A knitting machine according to claim 2 wherein an electronic control device is provided, allowing reversal of the carriage at any desired position on the needle beds made up from different segments.

6. A knitting machine according to claim 1 wherein the needle bed segments having different needle separations are arranged in the individual needle beds such that the segments are of different widths.

7. A knitting machine according to claim 1 wherein the needle bed segments having different needle separations are arranged in the individual needle beds such that the segments are asymmetrically distributed in the individual needle beds.

8. A knitting machine according to claim 1 wherein a separate needle drive is provided for each needle of each needle bed.

* * * * *